United States Patent [19]

Silk et al.

[11] 4,069,550

[45] Jan. 24, 1978

[54] CLOSURE PANEL HINGE

[75] Inventors: Leonard P. Silk, E. Lansing; Ernest G. Keefer, Grand Ledge, both of Mich.

[73] Assignee: General Motors Corporation, Detroit, Mich.

[21] Appl. No.: 738,560

[22] Filed: Nov. 3, 1976

[51] Int. Cl.[2] ..... E05D 15/58

[52] U.S. Cl. ..... 16/179; 16/128.1; 16/135; 16/166; 180/69 C

[58] Field of Search ..... 180/69 C; 16/179, 166, 16/135, 128.1

[56] References Cited

U.S. PATENT DOCUMENTS

| | | | |
|---|---|---|---|
| 2,193,112 | 3/1940 | Peterson | 180/69 C |
| 2,956,303 | 10/1960 | Fiedler | 16/128.1 |
| 2,959,808 | 11/1960 | Limberg | 16/179 |
| 3,388,417 | 6/1968 | Upchurch | 16/128.1 |
| 3,639,943 | 2/1972 | Cadiou | 16/179 X |
| 3,815,176 | 6/1974 | Porter | 180/69 C |

*Primary Examiner*—James Kee Chi

*Attorney, Agent, or Firm*—Charles E. Leahy

[57] ABSTRACT

A closure panel hinge for a vehicle body engine compartment hood panel includes a body bracket mounted on the vehicle body and a hood bracket mounted on the hood panel. The body bracket has an inclined bearing surface and a reversely bent flange which overlies the bearing surface. The hood bracket has a rearward end which bears on the bearing surface of the body bracket. A pin extends from the body bracket and rides in a curvilinear forwardly inclined slot in the hood bracket. As the hood is pivoted upwardly to the open position, the engagement between the pin and slot effects bodily forward shifting movement of the hood panel and simultaneous upward and forward migration of the point of contact of the hood bracket with the bearing surface of the body bracket, thereby preventing interference of the hood panel with the vehicle body structure.

4 Claims, 3 Drawing Figures

CLOSURE PANEL HINGE

The invention relates to closure panel hinges and more particularly vehicle body hood hinges.

Motor vehicle bodies have an engine compartment which is closed by a hood panel. The hood panel is hinged to the vehicle body at one of its ends for pivotal movement between opened and closed positions. One type of well-known hood hinge comprises a plurality of links pivotally connected in a parallelogram configuration which bodily shifts the rearward end of the hood panel vertically and forward during movement of the hood panel from the closed to the open position. This bodily shifting movement of the hood panel is advantageous because it eliminates any problem of the rearward end of the hood panel interfering with the cowl or with the bulkhead structure which separates the passenger compartment from the engine compartment. A disadvantage of these parallelogram type hood hinges is that they are relatively expensive to manufacture and add weight to the vehicle.

From a manufacturing and weight standpoint it would be desirable to utilize a simple strap hinge i.e., strap attached to the hood panel, a strap attached to the vehicle body, and a pivot pin connecting the straps. However, it has been found that the space and styling limitations in modern motor vehicles dictate that the pivot pin of the hinge be located longitudinally forward the rearward corners of the hood panel and at a lower elevation than the surface of the hood panel. Accordingly, the use of a simple strap hinge would result in the rearward end of the hood panel dipping below the normal elevation of the hood panel. Accordingly, the rearward end of the hood panel would interfere with the vehicle body structure.

According to the invention, a closure panel hinge for a vehicle body engine compartment hood includes a body bracket mounted on the vehicle body and a hood bracket mounted on the hood panel. The body bracket has an inclined bearing surface and a reversely bent flange which overlies the bearing surface. The hood bracket has a rearward end which bears on the bearing surface of the body bracket and is overlaid by the reversely bent flange. A pin extends from the body bracket and rides in a curvilinear forwardly inclined slot in the hood bracket. As the hood is moved to the open position, the engagement between the pin and slot effects bodily forward shifting movement of the hood panel and simultaneous upward and forward migration of the point of contact of the hood bracket with the bearing surface of the body bracket. The bodily forward and upward shifting movement of the hood panel prevents interference of the hood panel with the vehicle body structure.

One object, feature and advantage of the invention is the provision of a simplified closure panel hinge for bodily shifting a vehicle body closure panel forwardly and upwardly during opening movement.

Another feature, object and advantage of the invention is the provision of a closure panel hinge comprised of sheet metal brackets which are interfitted for pivotal movement without the necessity of an interconnecting pivot pin.

A still further feature, object and advantage of the invention is the provision of pin and slot cam means interconnecting hinge brackets and effecting bodily shifting movement of one bracket relative the other during movement of an associated closure panel between open and closed positions.

These and other objects, features and advantages of the invention will become apparent upon consideration of the specification and appended drawings wherein:

FIG. 3 is a view similar to FIG. 1 but showing the closure panel in the open position.

Figure 1:
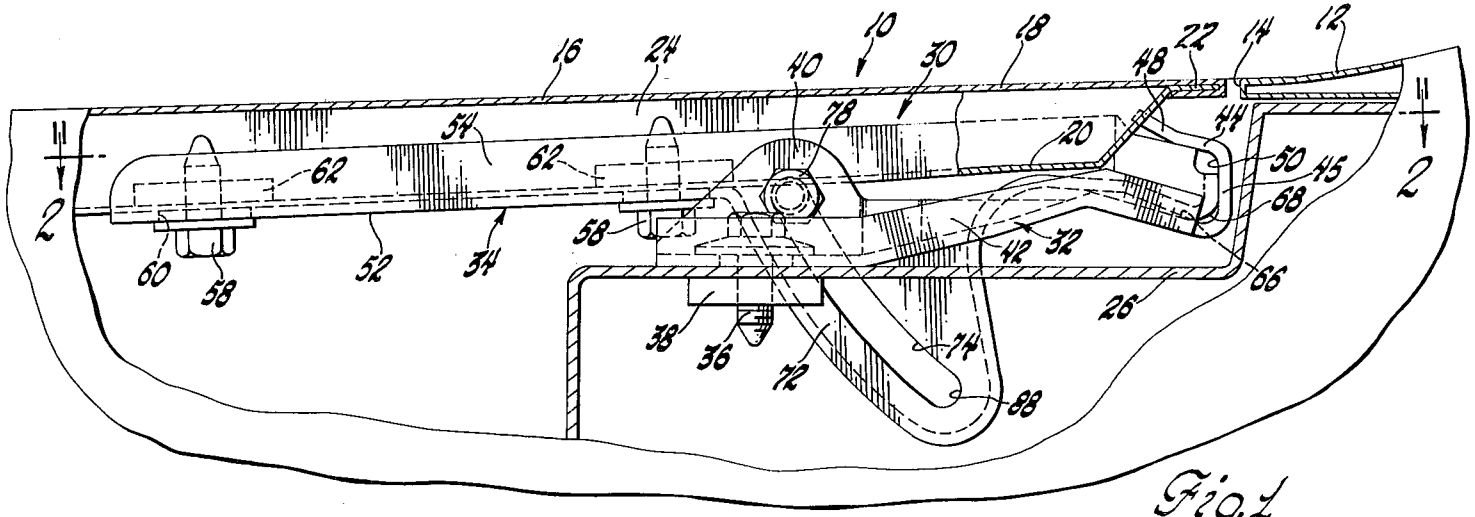
FIG. 1 is a side elevation view of a closure panel hinge according to the invention showing the closure panel in the closed position.
Figure 2:
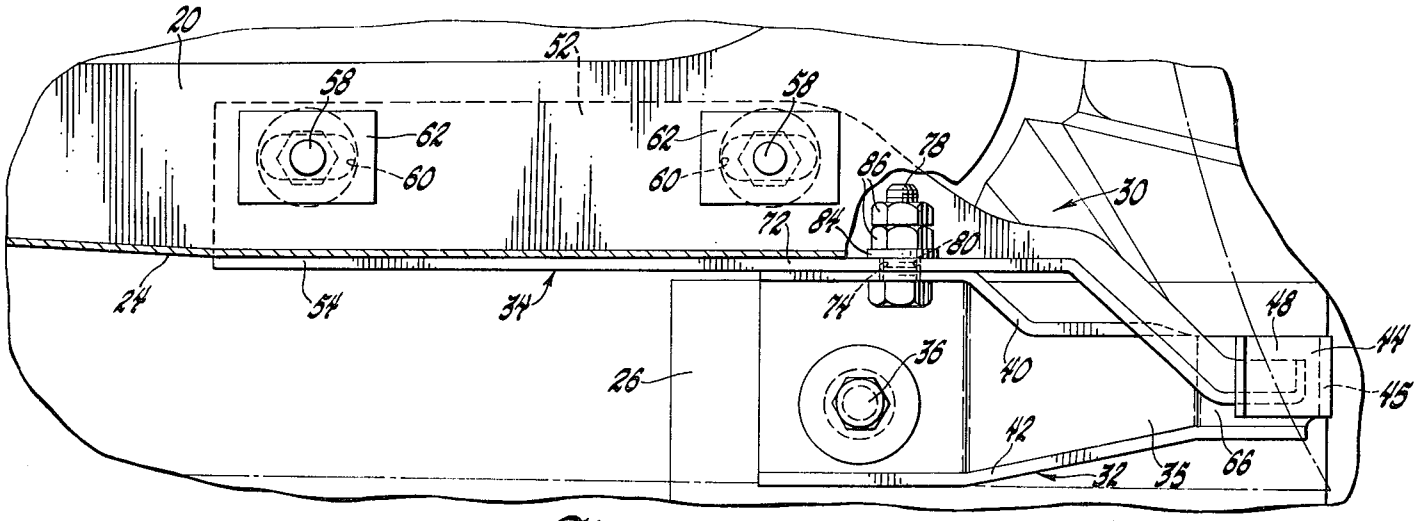
FIG. 2 is a plan view taken in the direction of arrows 2—2 of FIG. 1.
Figure 5:
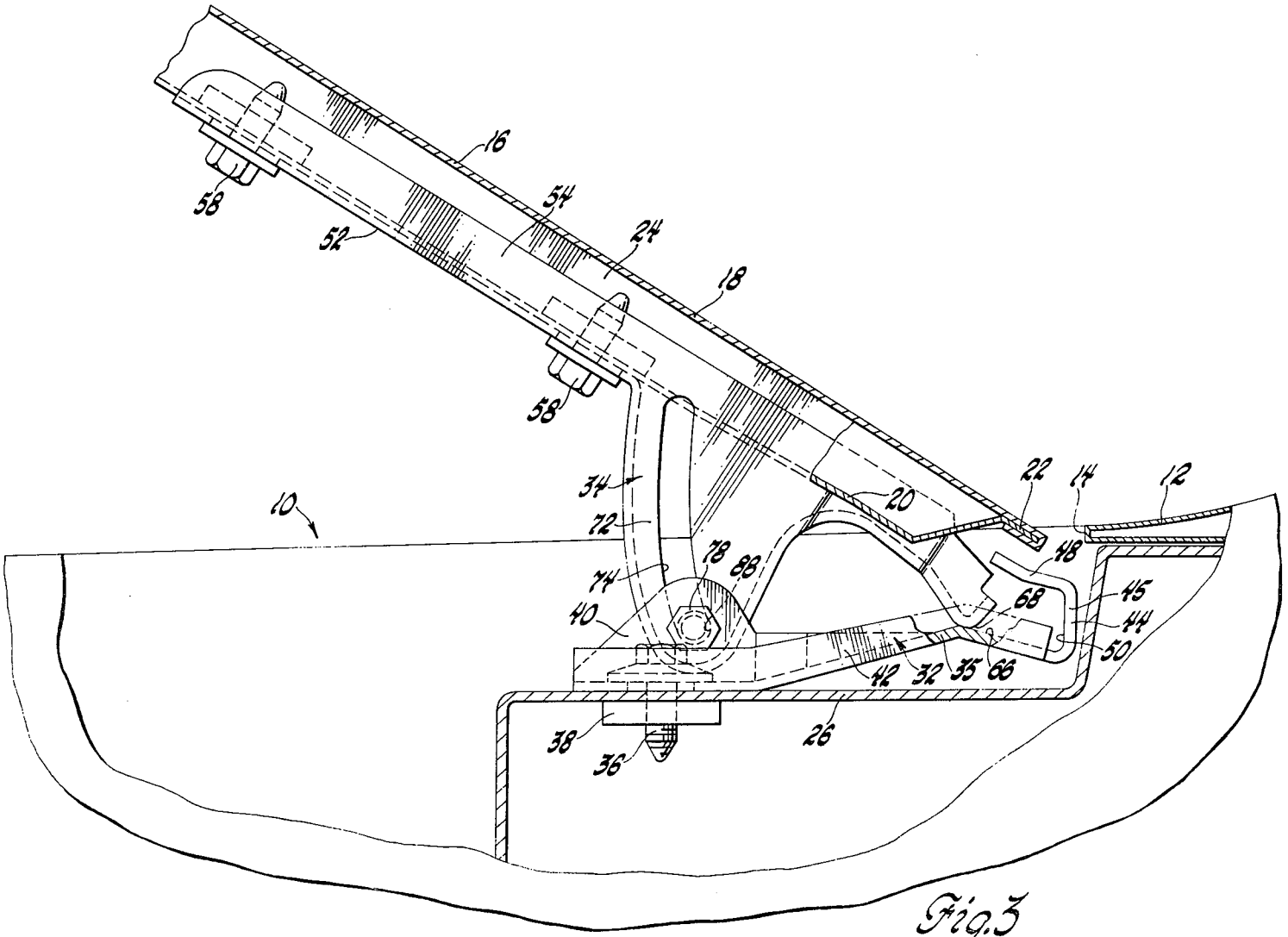

Referring to FIG. 1, there is shown a fragmentary view of a motor vehicle body generally indicated at 10. The vehicle body includes a cowl panel 12 which defines the rearward edge of a hood opening 14 providing access to the vehicle engine compartment. A hood panel 16 is provided for selectively opening and closing the opening 14 and is comprised of an outer panel 18 and an inner panel 20 which are flanged together at their outer peripheral edges as best seen at the rearward end 22, of hood panel 16. The inner panel 20 is formed to define integral stiffening portions, one of which defines a vertically extending wall 24.

The vehicle body 10 has a body panel 26 which defines a bulkhead structure separating the passenger compartment from the engine compartment. The body panel 26 provides a support upon which the hood panel 16 is pivotally mounted.

A hood hinge assembly, generally indicated at 30, includes a pair of stamped sheet metal brackets 32 and 34. The bracket 32, hereinafter referred to as the body bracket 32, includes a base wall 35 attached to the body panel 26 by a bolt 36 and a nut 38. The body bracket 32 also has laterally spaced inner and outer side flanges 40 and 42 which stiffen the base wall 35 against flexure. The rearward end of the body bracket 32 has an integrally formed, reversely bent flange 44 defined by a vertically upstanding wall 45 and a forwardly extending wall 48 which cooperate to define a forwardly opening recess 50.

The hood bracket 34 of hood hinge 30 includes a generally planar base wall 52 and a vertically upstanding wall 54 which stiffens the base wall 52 against flexure. The wall 54 lies adjacent the vertical wall 24 of hood inner panel 20. The hood bracket 34 is attached to the hood panel 16 by bolts 58 which extend through slotted apertures 60 in the hood bracket 34 and are threadedly received in nuts 62 which overlie the inner panel 20. The slots 60 permit fore and aft adjustment of the position of the hood panel 16 to obtain the desired fit relative the hood opening 14.

As best seen in FIGS. 1 and 3, the rearward end of the base wall 35 of body bracket 32 is formed to provide a bearing surface 66 which is inclined relative the horizontal. The rearward end of hood bracket 34 is bent upwardly and provides a downwardly facing curved surface 68 which bears on the bearing surface 66 of body bracket 32.

The body bracket 32 and hood bracket 34 are connected by a pin and slot cam arrangement. The hood bracket 34 has a downwardly extending wall 72 in which a slot 74 is provided. Bolt 78 extends through an aperture 80 of the body bracket sidewall 40 and through the slot 74. A washer 84 and pair of jam nuts 86 are received on the threaded end of bolt 78. The head of bolt 78 and the washer 84 bear loosely against the body bracket side wall 40 and the hood bracket wall 72 so that the hood bracket 34 is permitted to move relative to body bracket 32.

FIG. 3 shows the hood panel 16 moved to the open position. Comparing FIGS. 1 and 3, it will be seen that opening movement of the hood 16 causes pivotal motion of the hood bracket 34. This movement of the hood bracket 34 is guided and limited by the engagement between bolt 78 and the slot 74. Slot 74 is inclined forwardly so that the hood bracket 34 and hood panel 16 are shifted bodily forward during the opening movement. Accordingly, as opening movement progresses, the rearward end 22 of the hood panel 16 moves forwardly away from the hood opening 14. As this bodily shifting forward movement occurs, the point of contact between the curved surface 68 of hood bracket 34 and the bearing surface 66 of body bracket 32 migrates up the incline of the bearing surface 66. The upward migration of the point of contact prevents the rearward end 18 of hood panel 16 from dipping below the elevation of the cowl panel 12. The bodily shifting forward and upward movement of the rearward end of the hood panel 16 prevents potential interference of the hood panel 16 with the cowl 12 and body panel 26.

Movement of the hood in the opening direction is limited by engagement of a lower end 88 of slot 74 with the bolt 78. As best seen in FIG. 3, the forwardly estending wall 48 of the reversely bent body bracket flange 42 extends forwardly sufficiently to overlie and capture the upwardly bent end of hood bracket 32 even when the hood bracket 32 is shifted to its forwardmost position of FIG. 3.

When the hood panel is moved from the open position to the closed position, the bolt 78 and slot 74 cooperate to return the hood bracket 34 and hood panel 16 to their positions of FIG. 1.

It will be understood that a rivet or similar device may be used in place of the bolt 78 to form the pin and slot cam arrangement.

Thus, the invention provides a new and novel closure panel hinge which is particularly suited for motor vehicle hood hinges.

What is claimed is:

1. A hinge for mounting a closure panel on a vehicle body comprising:

a body bracket mounted on a vehicle body and having a support surface;

a panel bracket nonrotatably mounted on the closure panel and having an end portion slidably bearing on the support surface of the body bracket to support the closure panel during pivotal movement between open and closed positions, the point of bearing contact between the panel bracket end portion and the body bracket migrating along the support surface during pivotal movement of the hood, the support surface of the body bracket being inclined relative the horizontal so that pivotal opening movement of the closure panel effects upward vertical movement of the closure panel to avoid interference with the vehicle body.

2. A hinge for mounting a hood on a vehicle body comprising:

a body bracket mounted on a vehicle body and having a forwardly opening reversely bent flange;

a hood bracket nonrotatably mounted on the hood and having a curved end portion engaged in the reversely bent flange of the body bracket and slidably bearing on the body bracket to pivotally mount the hood bracket on the body bracket and thereby mount the hood for pivotal movement between open and closed positions;

and a slot in one of the brackets and a pin mounted on the other bracket and riding in the slot to control forward and rearward movement of the hood bracket and thereby maintain the rearwardly curved end of the hood bracket captured within the reversely bent flange of the body bracket, the slot having an end engagable by the pin to limit movement of the hood in the opening direction.

3. A hinge for mounting a hood on a vehicle body comprising:

a body bracket mounted on the vehicle body and having a forwardly opening reversely bent flange;

a hood bracket nonrotatably mounted on the hood and having a curved end portion engaged in the reversely bent flange of the body bracket to pivotally mount the hood bracket on the body bracket;

a cam follower carried by one of the brackets;

means on the other bracket defining a cam surface, the cam surface being inclined forwardly with respect to the vertical so that the hood bracket and the hood are moved bodily forward during pivotal movement from the closed position to the open position.

4. The hinge according to claim 3 further characterized by the reversely bent flange of the body bracket overlying the curved end portion of the hood bracket whereby the hood bracket is captured against forced rearward movement.

* * * * *